US008931236B2

(12) United States Patent
Sinclair

(10) Patent No.: US 8,931,236 B2
(45) Date of Patent: Jan. 13, 2015

(54) SYSTEM FOR ANCHORING A LOAD

(76) Inventor: Mark Ronald Sinclair, Lindfield (AU)

( * ) Notice: Subject to any disclaimer, the term of this patent is extended or adjusted under 35 U.S.C. 154(b) by 0 days.

(21) Appl. No.: 13/818,522

(22) PCT Filed: Aug. 24, 2011

(86) PCT No.: PCT/AU2011/001082

§ 371 (c)(1),
(2), (4) Date: Feb. 22, 2013

(87) PCT Pub. No.: WO2012/024725

PCT Pub. Date: Mar. 1, 2012

(65) Prior Publication Data

US 2013/0152496 A1 Jun. 20, 2013

(30) Foreign Application Priority Data

Aug. 24, 2010 (AU) ..... 2010903784

(51) Int. Cl.

| | |
|---|---|
| ***E02D 5/80*** | (2006.01) |
| ***E04C 5/08*** | (2006.01) |
| ***E02D 5/74*** | (2006.01) |
| ***E02D 5/76*** | (2006.01) |
| ***E02D 27/50*** | (2006.01) |

(Continued)

(52) U.S. Cl.

CPC .. *E02D 5/74* (2013.01); *E02D 5/76* (2013.01); *E02D 27/50* (2013.01); *E04G 21/00* (2013.01); *E01D 22/00* (2013.01)

USPC ..... 52/745.21; 52/223.13

(58) Field of Classification Search

CPC ..... E02D 5/76; E02D 5/808; E02D 5/80; E02D 27/50; E04C 5/12; E04C 5/127

USPC ..... 52/166, 223.14, 223.13, 223.4, 223.1, 52/745.21; 405/259, 259.5

See application file for complete search history.

(56) References Cited

U.S. PATENT DOCUMENTS 3,602,000 A * 8/1971 Meheen ..... 405/211
3,658,296 A * 4/1972 Yegge ..... 254/29 A (Continued)

FOREIGN PATENT DOCUMENTS

AU 1946192 A 5/1993
EP 0356215 A2 2/1990

(Continued)

OTHER PUBLICATIONS

Andrew BW, Lenehan JR, Sheehy CD and Wilson R.B. (1991), "Burrinjuck Dam Flood Security Upgrading" Australian National Committee on Large Dams (ANCOLD) Bulletin No. 87, pp. 35-49.

(Continued)

*Primary Examiner* — Christine T Cajilig

(74) *Attorney, Agent, or Firm* — Harness, Dickey & Pierce, PLC

(57) ABSTRACT

The invention relates to a method for anchoring a load (26) to an anchorage (30) utilizing at least one unitary anchoring tendon (10) including a plurality of tensile elements (12) each having a free length (14) and a bond length (18). The tendon is located lengthwise in a bore (34) formed through the load into the anchorage, and different groups (G1, G2, G3) of the strands of the tendon are tensioned in a predetermined sequence to a respective initial displacement length prior to the different groups being collectively tensioned to a respective final displacement length to anchor the load.

20 Claims, 6 Drawing Sheets

(51) Int. Cl.
*E04G 21/00* (2006.01)
*E01D 22/00* (2006.01)

(56) References Cited

U.S. PATENT DOCUMENTS

| | | | | | |
|---|---|---|---|---|---|
| 4,000,623 | A | * | 1/1977 | Meardi | 405/259.5 |
| 4,094,117 | A | * | 6/1978 | Torti et al. | 52/698 |
| 4,442,646 | A | * | 4/1984 | Prevedini | 52/223.13 |
| 4,505,081 | A | * | 3/1985 | Dinis et al. | 52/223.14 |
| 4,694,623 | A | * | 9/1987 | Herrmann | 52/223.13 |
| 5,154,540 | A | | 10/1992 | Barley | |
| 5,289,626 | A | * | 3/1994 | Mochida et al. | 29/452 |
| 5,469,677 | A | * | 11/1995 | Luthi | 52/223.13 |
| 5,809,710 | A | * | 9/1998 | Jungwirth et al. | 52/223.1 |
| 6,571,518 | B1 | * | 6/2003 | Barley | 52/223.13 |
| 2006/0201100 | A1 | * | 9/2006 | Langwadt et al. | 52/741.1 |

FOREIGN PATENT DOCUMENTS

| | | | |
|---|---|---|---|
| EP | 0577421 | A1 | 1/1994 |
| EP | 1240392 | A1 | 9/2002 |
| GB | 2223518 | | 4/1990 |
| GB | 2260999 | | 5/1993 |
| JP | 2002266347 | A | 9/2002 |
| WO | WO 00/08264 | | 2/2000 |
| WO | WO 01/40582 | | 6/2001 |

OTHER PUBLICATIONS

Cavill B. A., (1997) "Very High Capacity Ground Anchors Used in Strengthening Concrete Gravity Dams", in "Ground Anchorages and Anchored Structures", Edited by G. S. Littlejohn, Institution of Civil Engineers, London UK, Mar. 1997.

Cavill B., (2000) "Full Scale Testing of a 2400 tonne Capacity Rock Anchor", Australian National Committee on Large Dams (ANCOLD) Bulletin No. 114, pp. 213-223.

Cooper B.W., and Van Breda P., (1993) "Nepean Dam Flood Protection Measures", Australian National Committee on Large Dams (ANCOLD) Bulletin No. 93, pp. 34-56.

Ground Engineering Magazine, (Feb. 2002), p. 13. "Aussies claim anchor record".

Sinclair M. And Wark R.J., (2003) "Canning Dam Remedial Works, Australia's Largest Permanent Ground Anchors".

Snape D. W., Dowd R. and Van Breda P. (1989) "Cataract Dam Remedial Measures", Australian National Committee on Large Dams (ANCOLD) Bulletin No. 84, pp. 13-32.

Snape D. W., Dowd R. and Van Breda P. (1990) "Cataract Dam Remedial Measures", Australian National Committee on Large Dams (ANCOLD) Bulletin No. 85, pp. 97-100.

Snape D. W., Knight S. and Renn T., (1991) "Warragamba Dam Interim Flood Protection Measures", Australian National Committee on Large Dams (ANCOLD) Bulletin No. 87, pp. 50-78.

Snape D. W., (2001) "Sustainable Rehabilitation of Gravity Dams using Post Tensioned Cables", NZSOLD/ANCOLD 2001 Conference on Dams.

Wark R., Waters J., Vitharana N. and Somerford M., (2000) "Dam Safety Issues and Remedial Works at Canning Dam in Western Australia", ICOLD Q78-R38.

Williams a.C., and Snape D.W., (1981) "Development and Testing of Restressable Tendons for Manly Dam (Interim Report)", Australian National Committee on Large Dams (ANCOLD) Bulletin No. 58, pp. 12-32.

International Search Report (mailed Nov. 8, 2011) and International Preliminary Report on Patentability (mailed Aug. 24, 2012) for PCT/AU2011/001082, ISA/AU.

Barley, A. D. And Windsor, C. R., (2000). "Recent advance in ground anchor and ground reinforcement technology with reference to the development of the art", GeoEng2000, International Conference on Geotechnical and Geological Engineering, Melbourne, Nov. 19-21, Melbourne, Australia.

Ostermeyer H. and Barley T., "Fixed Anchor Design Guidelines", later published in Geotechnical Engineering Handbook vol. 2, Pub. Ernst & Sohn, 2003.

Barley A. D., Slope stabilization by new ground anchorage systems in rocks and soils. Proc. Conf. Slope Stability Engineering Development and Applications, Isle of Wight, UK, 1991, 313-318.

Mothersille D. K. V., The single bore multiple anchor system—Recent case histories. Presented by Mothersville, D. K. V., Hong Kong, Mar. 2012.

Bruce D. A. and Barley A. D., 2003. Two important recent developments in ground anchor technology. in Proc. Conf. On Soil and Rock., America. ISSMFE/ARMA/GI/MIT., Massechusetts.

Windsor C. R., 2004. A Review of long, high capacity reinforcing systems used in rock engineering. Ground Support in Mining and Underground Construction—Villaescura & Potrin (Eds), Tayler & Francis Group, London. ISBN 9058906408.

Barley a. D., 1997. The single bore multiple anchor system. Proc. Intern. Conf. Ground Anchorages and Anchored Structures, London.

Barley A. D., 1995. Theory and practice of the single bore multiple anchor system. International Symposium on "Anchors in Theory and Practice". Austria. Oct 9-10.

Menard Bachy Pty Ltd. Hunter River—South Arm. Ground Anchors—SBMA System. Extracts from internet web page http://www.menardbachy.com.au/ground_anchors.php, dated 2010.

Single Bore Multiple Anchors Ltd.—Extract from internet web pages http://www.sbmasystems.com/html/technical.htm, dated Jul. 23, 2009.

Brochure—Single Bore Multiple Anchor Ltd and Austress Menard Pty Ltd.

Brochure—Single Bore Multiple Anchor Ltd.

McBarron P., Vincent P. And Barley T., The use of temporary soil anchors in service Freeport Mine Irian Jaya, Indonesia. International Conference on Ground Anchorages, London, 2007.

* cited by examiner

SYSTEM FOR ANCHORING A LOAD

CROSS-REFERENCE TO RELATED APPLICATIONS

This application is a 371 U.S. National Stage of International Application No. PCT/AU2011/001082, filed Aug. 24, 2011, which claims priority to Australian Patent Application No. 2010903784, filed Aug. 24, 2010. The disclosures of the above applications are incorporated herein by reference.

FIELD OF THE INVENTION

The present invention in one or more forms relates to anchoring systems and the use of ground anchor(s) to anchor a structure against an applied force and/or provide stability to the structure. The invention has application in civil engineering works with particular, though not exclusive application, to the anchoring of large structures such as concrete dam walls.

BACKGROUND OF THE INVENTION

Large capacity permanent rock anchors are typically utilised in civil engineering works to contain large forces, examples of which include bridge restraints and to tie down concrete dams to improve their safety via resistance to overturning or sliding. It was not until about 1980 that improvements in technology allowed large capacity permanent anchors to be considered a long term viable option for high load applications, with ground anchors having capacities of about 10,500 kN UTS then 13,750 kN UTS being developed. However, these anchor tendons were highly stressed and prone to corrosion since under load transfer conditions, horizontal cracking occurs in the anchoring grout (particularly about the intersection of the free and bond length of the anchor) allowing aggressive agents to attack the highly stressed tendon. A polyethylene corrugated sheath is therefore employed to provide an impermeable membrane about a permanent tendon. However, based on the inside diameter of the corrugated sheath, the ultimate load transfer through the corrugated sheath is limited to around 5.3 MPa using a 35 MPa grout.

The expected life of permanent ground anchors is nominally 100 years. Grout additives are often used in order to reduce the quantity of water in a grout mix, enabling higher grout strengths to be achieved. However, grout additives, in addition to the cement and water used in the grout, are yet to be proven as having no adverse effect over the life of a permanent anchor. As such, grout additives are usually avoided due to the lack of conclusive proof that they are inert with respect to the anchor over an extended period of time, particularly in the bond zone where there is contact with the tendon.

Current high quality cement grouts for use with ground anchors over the bond length of the anchor typically employ a Portland cement such as Class "G" oilwell cement (to API Spec 10 A Type "G" HSR) with a water cement ratio of between 0.36 and 0.38, without any additives. When the free length of respective of the strands of the tendon are encased inside individual wax or grease filled polyethylene (PE) sheaths, the grout properties can be less stringent outside the bond length as there is no direct contact between the grout and the free length of the strands. Typically, for major projects, the grout is produced using a high shear mixer (colloidal) usually operating at about 2000 rpm. This approach fully wets the cement particles and minimises bleed water with the resulting grout reliably producing a compressive strength of approximately 70 MPa and a typical shear strength in a range of 10%-15% of the compressive strength once cured for 28 days.

Current ground anchoring technology is limited to the use of anchoring tendons comprising 91 strands with a breaking load of approximately 25,400 kN. The physical capacity of the tendon is not the limiting factor but rather, the ability to transfer load to the surrounding rock. There are two particular problems with load transfer namely, firstly the rock's physical capacity to carry higher stress loads and secondly, the ability of the grout and the sheathing to mechanically transfer the load without failure.

Large capacity multi-strand ground anchors are subjected to multi-strand tensioning to anchor the relevant load and minimise the risk of de-bonding of the top section of the anchor's bond zone with the surrounding ground strata. Multi-strand tensioning of the tendon involves gripping all of the respective strands of the tendon and collectively extending each strand a common distance uniformly at the same time to introduce load into the anchor.

To provide higher capacity permanent anchors the currently available options are to either provide a higher shear strength grout or to reduce the working stresses on the tendon by increasing load transfer area of the tendon such as by utilising a greater diameter anchor/sheath or bore hole. However, the former of these options would require the addition of additives to the grout which may be deleterious over time to the integrity of the anchor while the latter possibility only delivers a marginal improvement in load transfer/anchoring capacity of the anchor. Moreover, while the bond length of the strands of very high capacity ground anchors is nominally limited to around 12 m, as load transfer typically occurs over only the initial 6 m of the bond zone of an anchor.

Ground anchoring methods in which multiple separate anchoring tendons are arranged in the one borehole are known. In the anchoring system described in GB 2,223,518 four separate anchoring tendons are employed, the tendons being of different lengths to one another. Each of the tendons has a corrugated plastic capsule enclosing a further corrugated plastic tube in which the greased free length of the tendon is enclosed. The capsules of the tendons are staggered relative to one another along the bore and the bore is filled with grout as is each capsule and the associated inner plastic tube of the respective tendons. In other forms of that anchoring system an inner tube is not provided in the capsules of the tendons. However, in each instance, each respective anchoring tendon is independently subjected to multi-strand tensioning using a jack to tension the tendon uniformly as single unit to anchor the relevant load. Further anchoring systems comprising a single bore arrangement in which multiple separate anchoring tendons/tensile elements are inserted are described in International Patent Application No. WO 00/08264, WO 01/40582 and GB 2,260,999. In each of these systems, each anchoring tendon is again tensioned uniformly as a single unit.

SUMMARY OF THE INVENTION

Broadly stated, the invention stems from the recognition that the load transfer capacity of an anchoring tendon with multiple tensile elements may be substantially increased by sequentially tensioning different groups of tensile elements of the tendon in a predetermined sequence to a respective initial displacement length, and then progressively collectively tensioning respective of the groups of tensile elements at the same time to their final displacement length based on the final load requirement.

In particular, in an aspect of the invention there is provided a method for anchoring a load to an anchorage, comprising:

providing at least one unitary anchoring tendon including a plurality of tensile elements each having a bond length and a free length;

forming a respective bore through the load into the anchorage for receipt of the tendon;

locating the tendon lengthwise in the bore, the bond lengths of different groups of the tensile elements providing staggered bond transfer regions along a bond zone of the tendon for load transfer to the anchorage via grout with tensioning of the groups of tensile elements;

once the grout has sufficiently cured or set, tensioning the different groups of the tensile elements in a predetermined sequence to extend the free length of the tensile elements in those groups to a respective initial displacement length, to compensate for differences in the free length of the tensile elements between respective of the groups;

subsequently, collectively tensioning all of the tensile elements of the tendon at the same time to extend the free length of the tensile elements to a respective final displacement length; and securing the tendon to the load to maintain the tension in the tensile elements.

In still another aspect there is provided an anchoring tendon tensioned in accordance with a method embodied by the invention.

Typically, the predetermined sequence comprises sequentially tensioning the groups of the tensile elements of the tendon in a sequence from tensile elements with the longest free length to tensile elements with the shortest free length.

Typically, the groups of tensile elements are notionally ordered (e.g., by being differentially identified) and the tensioning of respective of the groups to their initial displacement length comprises collectively tensioning groups lower in the order with each group that is higher in the order, in turn.

Typically, each said group lower in the order is extended in sequence by a length determined to compensate for difference in the free length of the strands in that group with the strands in a group that is next highest in the order.

In another embodiment, the groups of tensile elements are notionally ordered, and each said group lower in the order is extended in said sequence by a length determined to compensate for difference in the free length of the strands in that group with the strands in a said group that is highest in the order. This embodiment may also comprise preliminary tensioning of the strand groups to an initial common predetermined tension level.

Typically, the difference between the initial displacement length and the final displacement length of each of the groups of tensile elements is essentially the same. However, the final displacement length for each group of tensile elements is different and is a function of the free length of the tensile elements in each respective group.

Typically, the same tensioning means is used to tension the groups of tensile elements to their initial and final displacement lengths. The tensioning means will generally consist of a single jacking device that is operated to extend each of the tensile elements in a respective group to the initial and final displacement lengths, the different groups of the tensile elements being engaged in sequence by the jacking device during the tensioning of the tendon.

Typically, the free lengths of the tensile elements in the different groups when tensioned to their respective final extension length are under substantially the same tension.

In at least some embodiments a primary sheath can be provided in the bore wherein at least the bond lengths of the tensile elements are disposed in the sheath, and the grout comprises internal grout about the respective bond lengths of the tensile elements and external grout in the bore outside of the sheath. The internal grout and the external grout can be the same or different grouts, and may differ between the bond and free length portions of an anchoring tendon.

The anchoring tendon can be employed as a temporary anchor or a permanent anchor. When used as a temporary anchor the anchoring tendon is typically employed without the use of the sheath in the bore.

Typically, a plurality of the anchoring tendons are used to anchor the load to the anchorage.

The tensile elements in each group of the tendon can be differentially identified for being tensioned to the initial displacement length in the predetermined sequence by one or more of different free lengths of the tensile elements (e.g., protruding from the load), and markings, cuttings, different colours, sheathing, tagging, heatshrink wrap, and labelling.

Hence, in another aspect of the invention there is provided an anchoring system for anchoring a load to an anchorage, comprising:

a unitary anchoring tendon including a plurality of tensile elements each having a bond length and a free length, the tendon being adapted for being inserted lengthwise into a bore formed through the load into the anchorage in use, the bond lengths of different groups of the tensile elements defining staggered load transfer regions along a bond zone of the tendon for transferring load to the anchorage via grout with tensioning of the groups of tensile elements, wherein the groups of tensile elements are differentially identified providing a predetermined sequence for the tensioning of the different groups of tensile elements to extend the free length of the tensile elements in each group to a respective initial displacement length once the grout has sufficiently cured or set.

In yet another aspect of the invention there is provided a unitary anchoring tendon being partially tensioned to anchor a load to a ground anchorage, the tendon comprising a plurality of tensile elements each having a bond length and a free length and being arranged lengthwise in a bore formed through the load into the ground anchorage, the bond lengths of different groups of the tensile elements defining staggered load transfer regions along a bond zone of the tendon, wherein selected said groups of the tensile elements of the tendon being extended by a different length compared to one another tensioned to a respective initial displacement length from a resting condition in the bore and to a greater tension level than a final said group of the tensile elements whereby the tendon is ready for collective tensioning of all of the groups of the tensile elements at the same time to extend the tensile elements essentially by the same predetermined length to a respective final displacement length for load transfer through the load transfer regions of the tendon to the ground anchorage via grout in the bore.

The tensile elements of an anchoring tendon according to an embodiment of the invention or utilised in a method of the invention may be selected from (normally high tensile) strands, wire, cable, bar and rod elements. Moreover, the tensile elements may be of any shape or form and be fabricated from carbon fibre, glass filament, or synthetic plastics, or from steel or metallic alloys conventionally used in the manufacture of ground anchors, or any other materials or compounds deemed suitable.

The load anchored by the anchoring tendon can, for instance, be used to anchor a ground (e.g., a cavern or a hillside), earthen, building or engineering structure or formation such as a dam wall, a dam spillway, a bridge, a bridge footing, lift core base, building foundation, a shear wall, earth or rock embankment or excavation, or for foundation preloading, or cavern stabilisation, or as a buoyancy restraint, load testing apparatus, a seismic reaction point, load reaction point, and/or or for providing reaction to overturning of the load. Moreover, the anchoring tendon can be used for remediation of a structure or formation such as described above.

Accordingly, the anchorage can, for instance, comprise rock, rock strata or other geotechnically suitable ground anchorages.

Advantageously, by tensioning the tensile elements of the anchoring tendon as described herein, the level of total load transfer from the anchoring tendon to the anchorage may be significantly increased without increasing the dimensions of the anchoring tendon (other than its length to accommodate additional bond length) and whilst avoiding de-bonding of the top section of the tendon's bond zone. As such, the stability of the load anchored by the anchoring tendon may also be enhanced. In addition, by increasing the load transfer capacity of a given tendon, a reduced number of larger anchoring tendons relative to smaller ground anchoring tendons may used to obtain the required level of anchorage in a particular application than otherwise may be the case, providing for the potential of significant time and cost savings.

Moreover, larger capacity anchoring tendons may be developed and/or implemented, and higher capacity anchors used in situations where they have previously been precluded due to bond transfer and geotechnical load transfer limitations.

The features and advantages of the invention will become further apparent from the following detailed description of a number of non-limiting embodiments of the invention.

BRIEF DESCRIPTION OF THE ACCOMPANYING DRAWINGS

DETAILED DESCRIPTION OF EXEMPLARY EMBODIMENTS OF THE INVENTION

Figure 1:
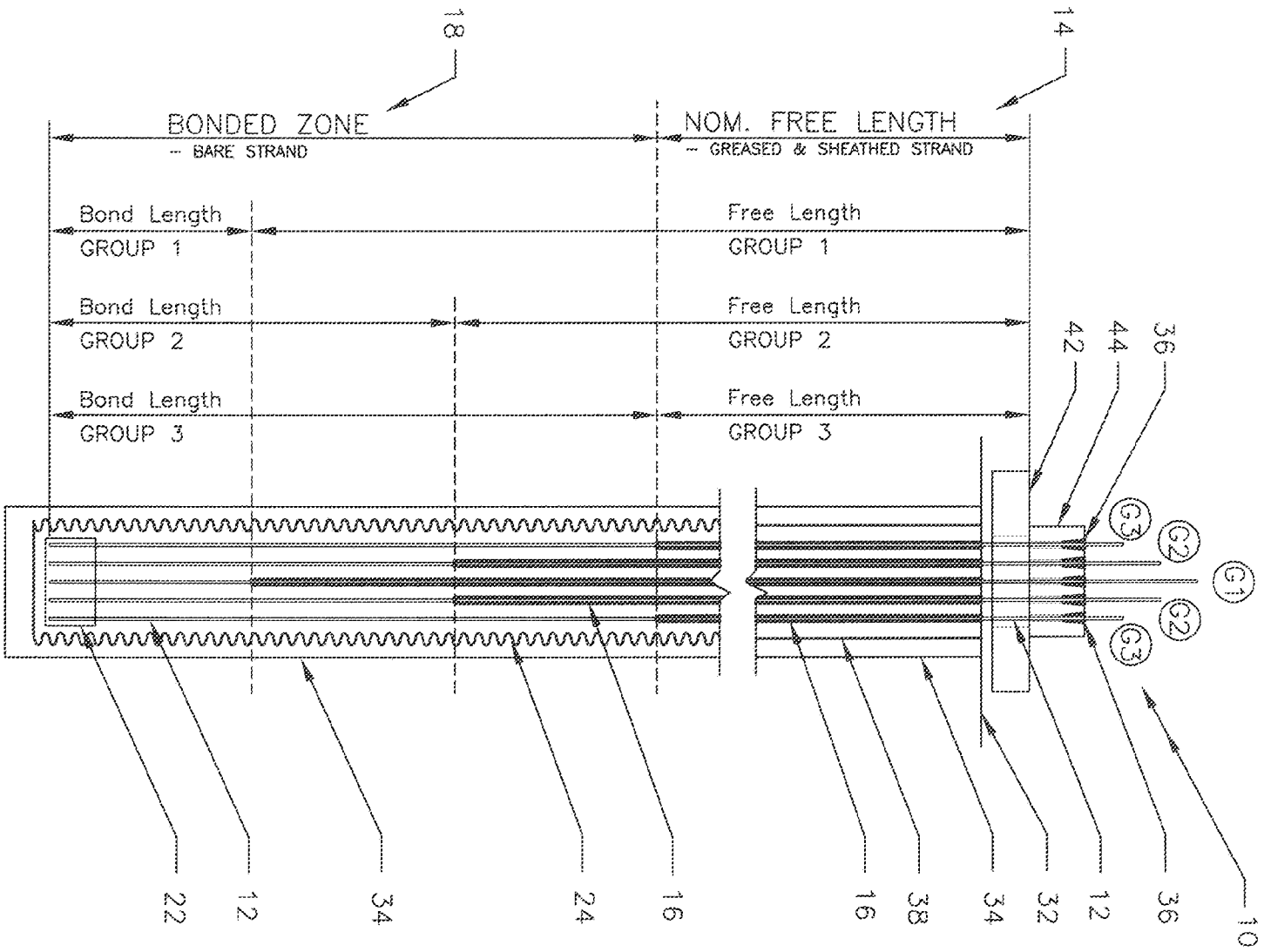
FIG. 1 is a schematic view of a multi-strand anchoring tendon illustrating strands of the tendon notionally ordered into different groups on the basis of their respective free lengths.

A unitary anchoring tendon 10 suitable for use in a method embodied by the invention is shown in FIG. 1. The tendon has a plurality of tensile elements in the form of multi-wire steel strands 12 each of which has a free length 14 received within a respective sleeve 16, and a bond length 18. The bond lengths 18 of the strands 12 terminate in the nose of the tendon generally indicated by the numeral 22 and are fixed together in the tendon's nose at their leading ends by an epoxy or suitable fixing system. In practice, the nose 22 is generally round ended as conventionally known to assist insertion of the tendon down the corrugated sheath 24 as further described below. The strands 12 of the tendon each comprise a central king wire about which a plurality of outer wires (typically 6) are spirally wound around. A seal (not shown) is located on the end of each sleeve 16 at the transition between the bond length and the free length of respective of the strands to stop entry of water or grout into the sleeve 16 or the loss of grease or wax (i.e., inert filler) coating the respective free lengths of the strands from the sleeve to protect the tendon against corrosion.

Typically, the leading end region of the tendon includes a number of spacers that are distanced apart from each other in the longitudinal direction of the tendon, and receive the strands 12 through respective apertures in the spacers so as to radially space the strands apart from one another. Tensile bands are also provided around the outer periphery of the tendon to either side of each spacer forming a "bird cage" arrangement as is known in the art. However, it will be understood tendons utilised in an embodiment of the invention are not limited to the particular such arrangement.

As indicated above, during preparation of the tendon, the free length 14 of each strand 12 is passed through a greasing/waxing machine that partially unravels consecutive lengths of the strand and thoroughly coats each strand with a grease to protect the strand against corrosion, and to fill the void between the bare tendon 12 and the inside of the sleeve 16. In other embodiments, each strand 12 can be factory greased and fitted with a respective sleeve 16, and the region of the sleeve (and any grease or wax) covering the bond length of each strand is removed when preparing the tendon for installation. While grease is suitable, the strand wires may be coated with any other essentially inert coating for inhibiting corrosion of the tendon deemed appropriate.

The invention is further described below in relation to the remediation of a dam spillway to improve stability of the structure under both static and earthquake loadings, to provide additional resistance to flood loads, and increase the working life of the dam. As will be understood, some such applications may allow for increased wall height to the dam. At least some like features and/or components of different embodiments of the invention have been numbered similarly for convenience in the description that follows.

Figure 3:
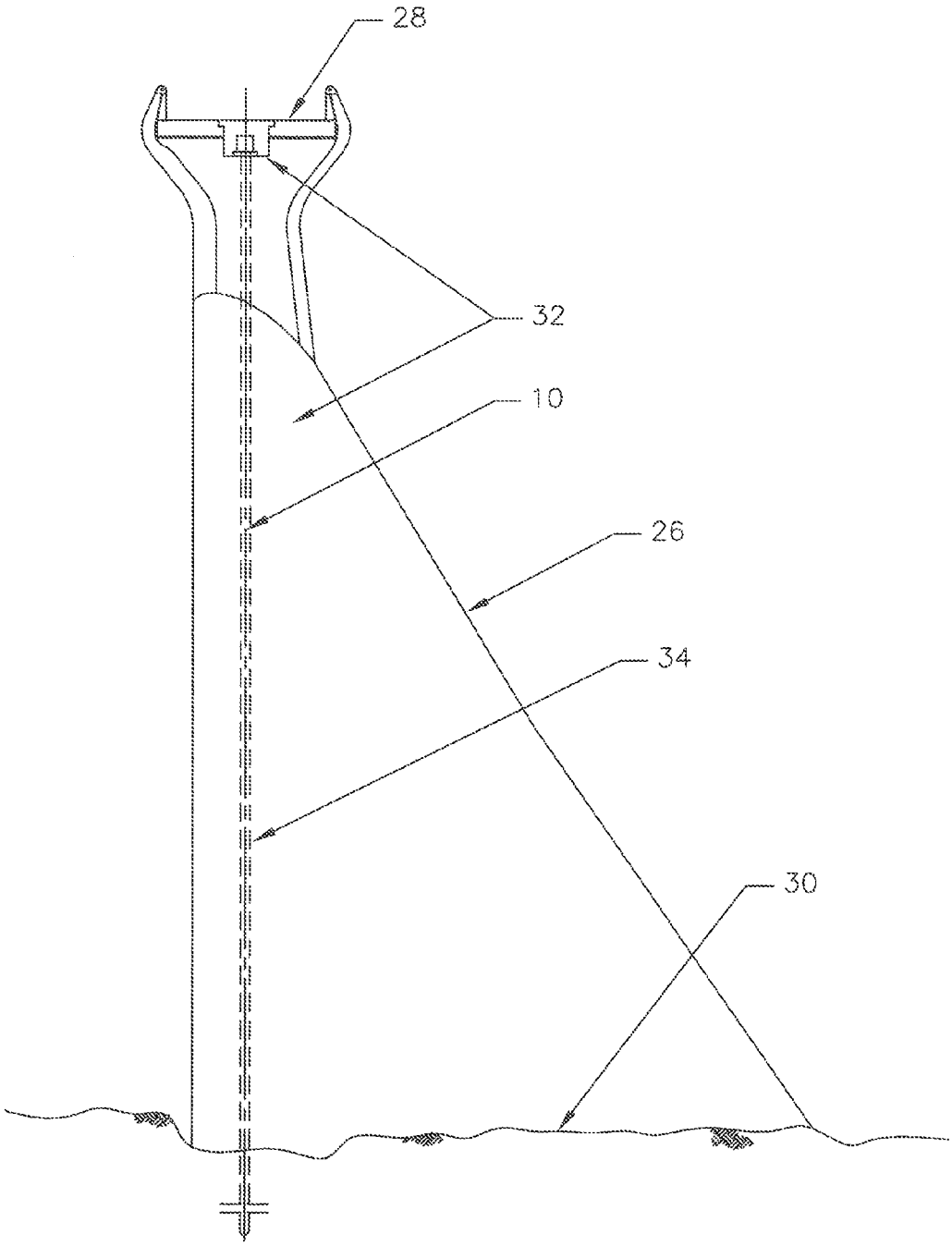
FIG. 3 is a side sectional view of a dam spillway illustrating the positioning of an anchoring tendon.
Figure 4:
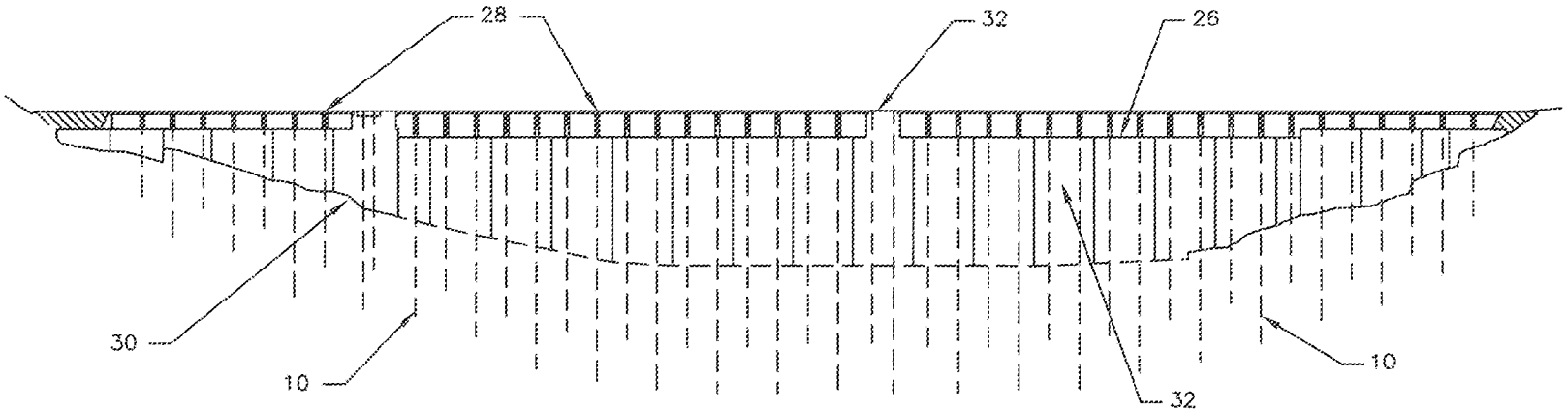
FIG. 4 is a front diagrammatic view of the dam spillway of FIG. 3 anchored to an underlying rock foundation by multi-strand anchoring tendons.

The dam spillway 26 shown in FIG. 3 and FIG. 4 comprising the load to be anchored in accordance with an embodiment of the invention is several hundred meters wide across its crest and is approx. 40 m at its highest point from the underlying rock foundation 30 forming the anchorage for the spillway. To remediate/upgrade the dam, anchoring tendons 10 are spaced apart from each other across the dam spillway to anchor it to the rock foundation. Each tendon is about twice the length of the section of the structure through which it extends. As such, the longest of the tendons in the middle region of the spillway are about 80 m in length. Moreover, the number of strands in each tendon decreases from 91 strands in the middle region of the spillway progressively down to 65, 55, 31, or 19 strands towards the outer sides of the spillway depending on the height of the dam, loadings and the geology of the underlying rock anchorage.

To position the tendons, respective recessed locations for receiving the tendons are excavated into the crest of the spillway as generally indicated by numeral 28 in FIG. 3, and a vertical bore hole 34 is drilled through the dam spillway into the underlying rock foundation for each tendon. As best illustrated in FIG. 1, a corrugated primary sheath 24 fabricated from a plastics material and having an end cover to seal its leading end is first lowered into the bore 34. As also indicated, a further smooth, straight walled sheath 38 is sealed to the top of the corrugated sheathing to protect the tendon from ingress or egress of water, grout or aggressive agents in situ. In other embodiments, the further sheath can also be corrugated, or the primary sheath can be of a length to also house the respective sleeves 16.

Bands of spacers are provided around the outer circumference of the corrugated sheath 24 and (where fitted) smooth sheath 38 at regular intervals along their length to space the sheaths from the wall of the bore 34 to allow cement grout to be injected into the bore about the sheaths. Once the sheaths 24 and 38 are in position, the tendon is transported from where it has been fabricated, and is installed into the opening of the bore. The tendon is then lowered into the sheaths 24 and 38 disposed within the bore under the control of cranes, winches and the like until in position with the bond lengths of respective of the tendon strands 12 extending into the rock foundation. It is possible that the whole tendon and sheath assembly can be prepared as a single unit prior to insertion in the bore 34, but this is dependent on there being minimal risk of damage occurring to the sheaths 24 and 38 during the particular installation process.

Once in position, cement grout (e.g., 60 MPa) (referred to herein as internal grout) is injected into the corrugated sheath 24 about the respective bond lengths of the strands 12. Further cement grout (referred to herein as external grout) is injected simultaneously into the bore 34 external to the corrugated sheath 24 and smooth sheath 38. The grouts are then allowed to fully cure for 7 to 28 days (depending the project specification, anchor size and conditions) to obtain sufficient strength to permit tensioning of the tendon. The grouts can be the same or different to one another. As will also be understood, the provision of the free length of each strand in a respective sleeve 16 allows for independent movement of the free length (i.e., as the free length is being extended) during the tensioning of the strand.

Figure 2:
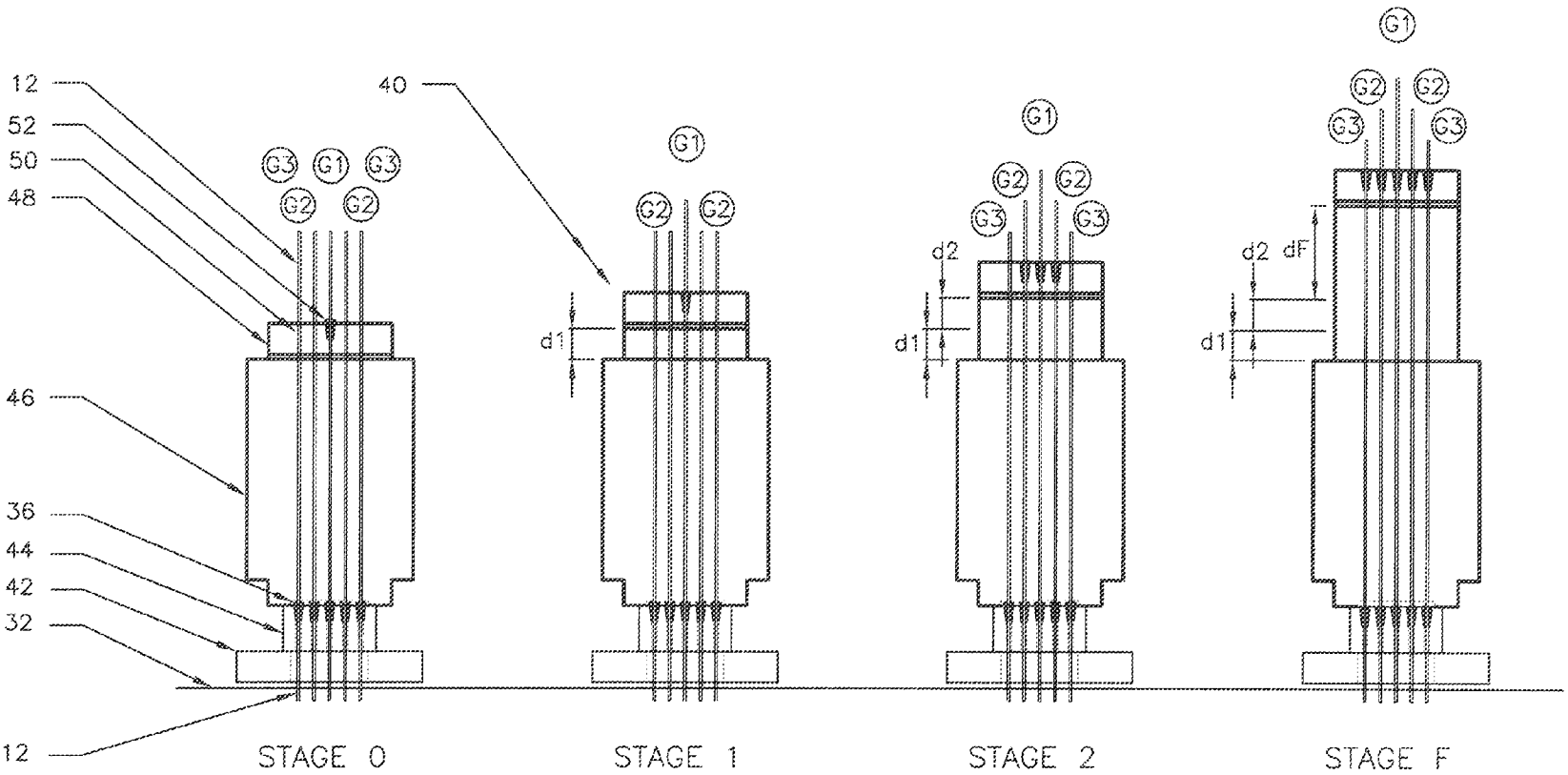
FIG. 2 shows tensioning of the strands of a multi-strand anchoring tendon using a jacking device in accordance with an embodiment of the invention.

A jacking device 40 or other tensioning apparatus is used to tension the strands of the respective groups within the tendon assembly. As shown in FIG. 2, the jacking device is in the form of a sing jack and receives each of the strands of a tendon, and comprises an anchorage bearing plate 42 seated on bed of mortar on the dam spillway as generally indicated by the numeral 32. A primary multi-strand anchoring head 44 is arranged on the bearing plate 42, which includes a plurality of clamping wedges 36 for preventing retraction of the tendon strands into the bore. A hydraulic stressing/tensioning jack 46 is seated on the anchoring head 44. Alternatively, an intermediate chair or frame can be used. In turn, an auxiliary anchoring head 48 is disposed on the jack 46 and is provided with seating apertures 50 respectively receiving a different strand 12 of the tendon. To grip and tension respective of the strands, clamping wedges 52 are selectively inserted into the corresponding seating aperture 50 of the auxiliary anchoring head about the selected strand, and the jack 46 is operated. For example, to tension a 91 strand anchoring tendon, a 2200 tonne capacity hydraulic jack is used whilst, for example, 1500 tonne and 650 tonne capacity hydraulic jacks can be respectively used for 65 strand and 27 strand anchoring tendons.

In accordance with the invention, different groups of the strands 12 are tensioned in a predetermined sequence by the jack 46 to extend each of the groups to a respective initial displacement length to provide load transfer to the rock foundation 30. The respective groups of the stands 12 are then collectively tensioned at the same time by the jack 46 and extended to their final displacement length. Typically, the initial tensioning of each group of strands is such that the individual strands in all the groups are substantially equally stressed regardless of the free length of the strands in each group. That is, the different groups of the strands are respectively tensioned in the predetermined sequence to achieve substantially the same level of stress/tension in all of the strands of the tendon, and then the strands are collectively tensioned at the same time to the final anchor load specified for the tendon. The different groups of the strands can be differentially identified (and thereby be notionally ordered) to indicate the sequence in which the groups are to be tensioned by any suitable method, such as being marked, cut to different lengths, tagged or colour coded (e.g., by paint or heat shrink wrap). Normally, the strands are divided into different groups on the basis of their respective free lengths, and the groups are tensioned in sequence from strands with the longest free length(s) 14 to those with the shortest free length(s).

The tensioning of the strands 12 of respective of the anchoring tendons 10 in the dam spillway 26 is also illustrated in FIG. 2. Whilst a tendon 10 is shown with only 5 strands 12 divided into 3 groups (G1-G3), it will be understood that the illustrated tensioning method is applicable to tendons with any number of strands (e.g., 91 strands).

As an initial step, the length that each group of strands of the tendon is to be extended to compensate for the difference in free lengths of the strands is calculated. The group with the longest free length is engaged first, and the strands in that group are extended by a distance that is equivalent to the difference in the required extension length between that group and the group of strands having the second longest free length. Both of those groups are then extended a distance that is equivalent to the difference in the required extension between the second of the groups and the group of strands having the longest free length. For tendons with more than three groups of strands, this process is repeated for each consecutive strand group. That is, the first three groups of strands are then extended by the difference in the required extension length between the third group of strands and the group of strands having the next longest free length, and so on. Once the second last group has been extended to its initial displacement length, all of the groups are then collectively extended by the same distance and at the same time to their respective final displacement lengths to provide the required tension in the strands of the tendon for load transfer to the underlying rock anchorage 30. At this point, all of the strands of the tendon are generally under substantially the same stress and loading. Thus, as will be understood, the overall length that each group of strands of the tendon is extended is dependent on the different free lengths of the respective groups of the strands, the requisite level of load transfer for the particular application in which the tendon is employed, and the material properties of the respective groups of strands.

More specifically, as illustrated in FIG. 2, the group 1 strand(s) (G1) (i.e., with the longest free length(s)) are initially tensioned by seating wedges 52 in the auxiliary anchoring head 48 about respective of the strands and operating the hydraulic jack 46 to extend the strands in that group a distance d1. The group 2 strands (G2) are then gripped, and the G1 and G2 group strands are tensioned with the use of further wedges 52 by operating the jack to extend the G1 and G2 strands a distance d2. This cycle is repeated as needed until all groups of strands except the last strand group of the tendon have been sequentially tensioned to their respective initial displacement length. Once, the initial tensioning of the strands in all but the last strand group has been achieved, the last strand group (in this case G3) is then engaged and the jack 46 is then operated to collectively extend all of strands of the respective groups at the same time a further final distance df to their final tension and respective final displacement length as generally illustrated in Stage F of FIG. 2. Thus, the tensioning of respective of the groups of strands in the predetermined sequence to their initial displacement length in the exemplified embodiment comprises progressively collectively tensioning groups lower in the order with each group that is higher in the order, in turn. As also shown in FIG. 2, in the present embodiment, the groups of the strands are sequentially tensioned in a direction radially outwardly from the centre group(s) of the strands (e.g., radially outwardly from the G1 strands).

The process illustrated in FIG. 2 assumes that the level of slack in the free length of the strands 12 in the respective groups of the tendon 10 is equal between the groups, and that correction for this slack occurs evenly across all of the strand groups during the tensioning of the strand groups. However, the differences in the slack in free strand length between different groups of strands compared to the shortest group of strands can be individually compensated for during the extension of the respective strand groups of the tendon to their initial displacement length in a method embodied by the invention. This can include tensioning each group of strands to a predetermined initial tension level (e.g., say 5% of the determined final tension in the strands) to provide for "zero correction".

Figure 5:
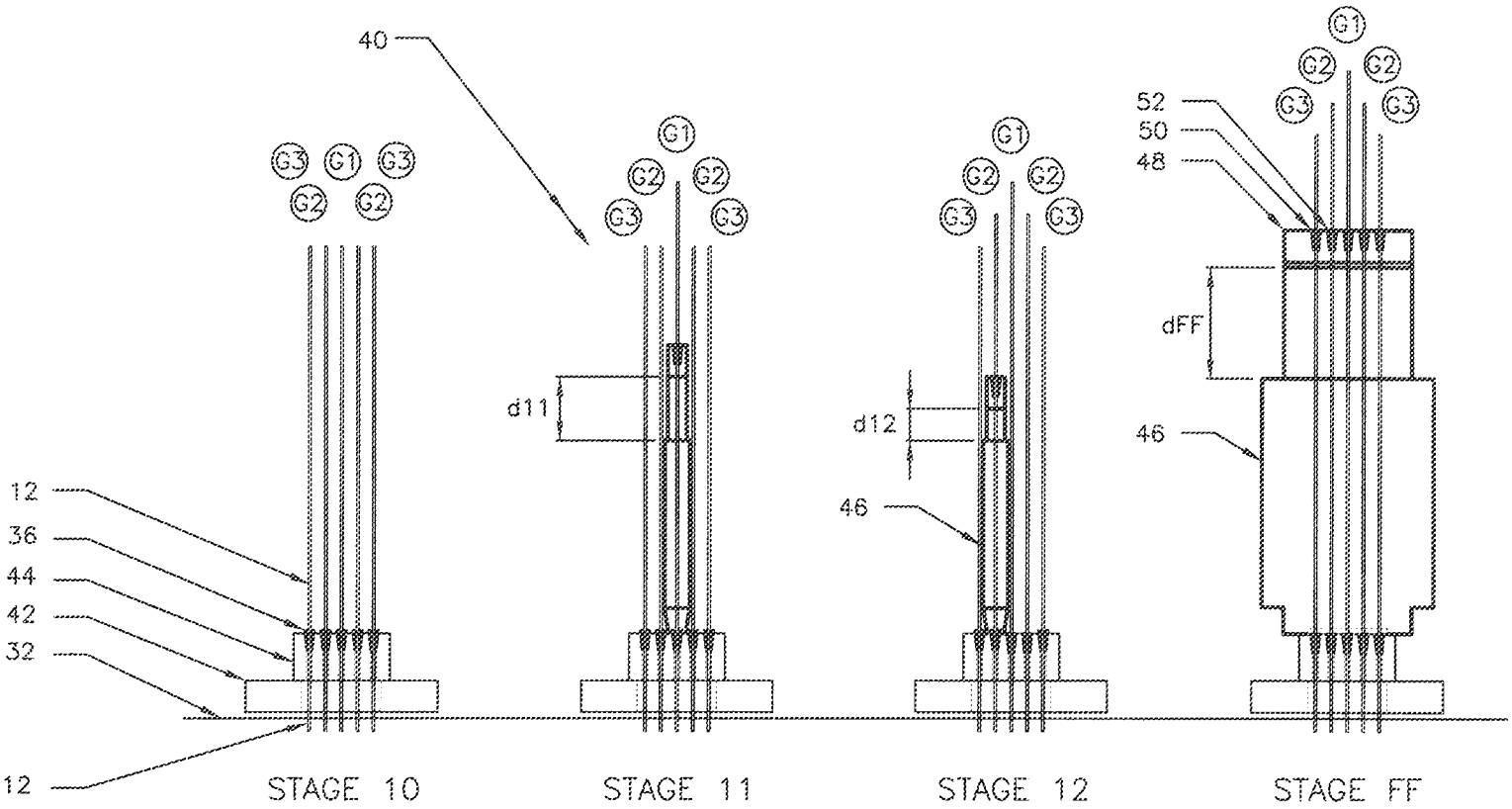
FIG. 5 shows tensioning of the strands of a multi-strand tendon using a jacking device in accordance with another embodiment of the invention.
Figure 6:
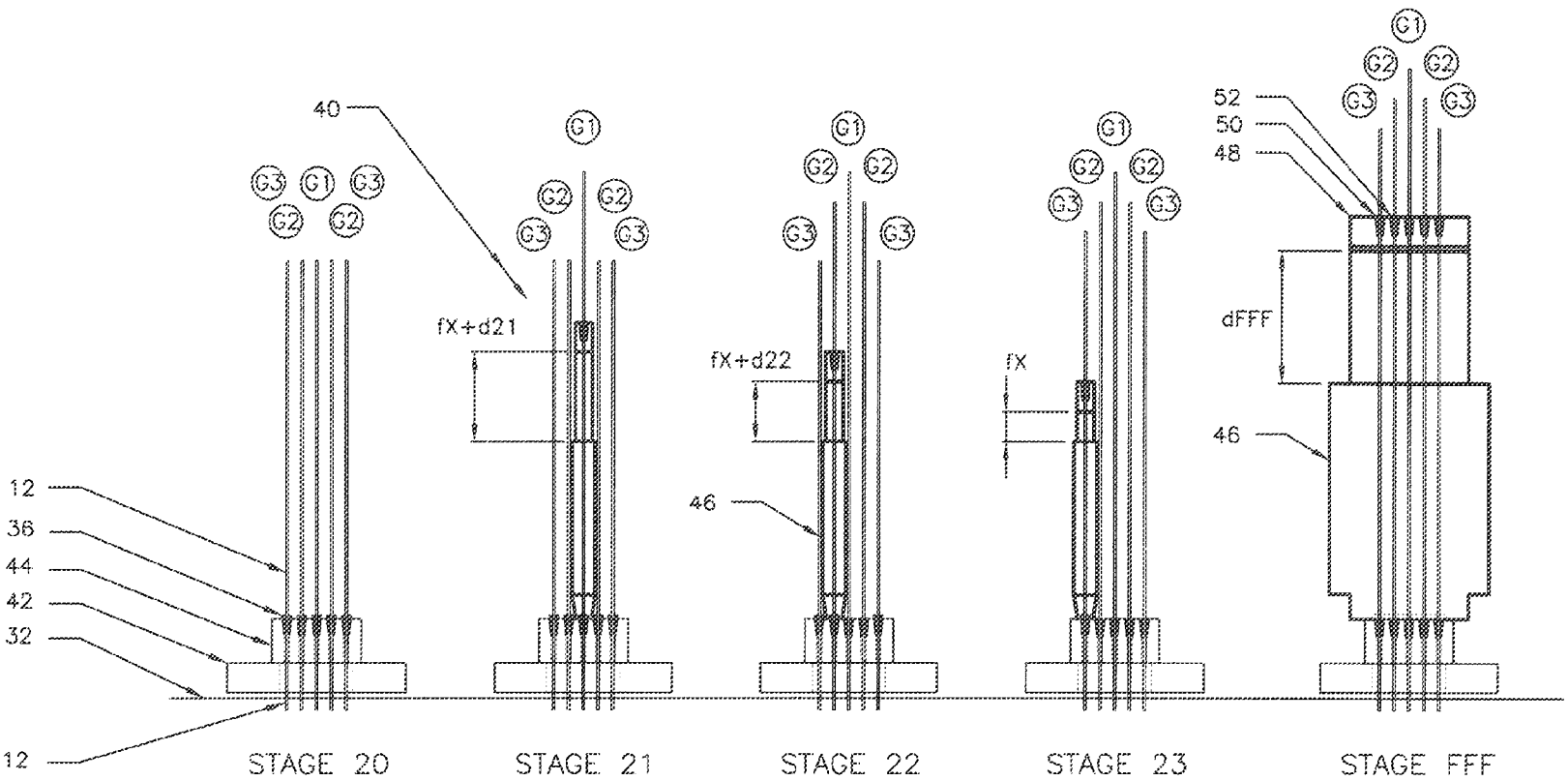
FIG. 6 shows tensioning of the strands of a multi-strand tendon using a jacking device in accordance with yet another embodiment of the invention.

In particular, in FIG. 5 and FIG. 6, a tendon 10 as described in FIG. 1 is illustrated with groups of strands G1, G2 and G3 although, the respective sleeves 16 are not shown. As with the embodiment shown in FIG. 1, strand group G1 has the longest free length, group G2 has a shorter free length, and group G3 the shortest free length. Assuming the final stressing tension is equally distributed across all strands 12 of the tendon in the anchored load, the extended final length of respective of the strands is proportional to their respective free length and the specific physical characteristics of the individual strands of each strand group. Hence, a strand 12 with a longer free length has a longer extension length than a strand 12 with a shorter free length in the anchored load. Thus, in the tendons 10 shown in FIG. 5 and FIG. 6 (as well as FIG. 1), the final extension length in the anchored load for strand group G1 is E1, the final extension length for strand group G2 is E2, and the final extension for strand group G3 is E3, where for the free lengths (f1), f1(G3)<f1(G2)<f1(G1) and final extension lengths of the strand groups are E3<E2<E1. The differences between these pre-calculated extension lengths allows compensation for slack in the free length of the strands in the respective strand groups to be provided in the tensioning process as further described below.

The method illustrated in FIG. 5 assumes the initial slack in the free length of the respective strand groups of the tendon 10 is essentially insignificant. Stage 10 shows the starting condition prior to commencement of the tensioning the tendon, where all strands of the tension are unloaded. In Stage 11, strand group G1 is initially extended a distance d11 by the jack to its initial displacement length where d11=E1−E3. That is, each strand in group G1 is extended by d11 to eliminate the difference in free length between this group and the shortest free length group G3. Similarly in Stage 12, the strands in group G2 are extended by a distance d12 where d12=E2−E3. However, in this embodiment, strand group G1 is not further extended with the initial extension of group G2 as occurs in the embodiment illustrated in FIG. 2. Moreover, only 2 of the 3 stand groups (G1-G3) are initially extended to remove the length difference between the groups. After completion of Stage 12, the final Stage FF involving the collective tensioning of all of strand groups G1-G3 simultaneously by a distance dFF to the final extension length of the respective strand groups is undertaken. That is, distance dFF is equal to the extension of the shortest free length strand group (G3) from zero to the final extension length for group G3. The total extension length therefore varies for each strand group, and is based on the difference of the free strand length between each strand group calculated utilising values E1, E2 and E3.

A method of tensioning the tendon 10 which more accurately accounts for slack in the different strand groups is illustrated in FIG. 6. In this embodiment, a common preliminary tension level is introduced into each respective strand group before the group is extended to its initial displacement length. The introduction of the common preliminary tension in the strand groups removes the slack in the free length of the strands in each group and provides a pre-set starting point for the subsequent tensioning of the strand groups.

The necessary displacement of the respective strand groups of the tendon 10 to achieve the required anchoring of a load via the method illustrated in FIG. 6 can be determined as follows. Firstly, the displacement lengths E1, E2 and E3 required to extend the respective strand groups from their starting length to the final tension is calculated, and a common preliminary tension (i.e., stressing force) "fX" is adopted for each strand group. As described above, the value of fX may be say 5% of the final calculated stressing force to which the tendon is to be tensioned to anchor the load, although lower or higher fX values can be employed as may be deemed appropriate for the particular situation.

The total displacement lengths E1, E2 and E3 required to extend the respective strand groups from their starting length to their final tension is then calculated. The displacement length required to extend the respective strand groups from when the common tension fX is applied to the strand groups (providing a "zero load" starting point) to their respective final displacement lengths is also determined as EX1 for group G1, EX2 for group G2 and EX3 for group G3. The staged tensioning sequence of the tendon 10 in the method of FIG. 6 is then:

- Stage 20 in which the strands of the different strand groups are all at their starting length prior to the commencement of tensioning of the tendon;
- Stage 21 in which group G1 is extended to apply the preliminary tension fX to respective of the strands in that group, and the group is then extended by displacement d21 wherein d21=(E1−EX1)+(EX3−E3);
- Stage 22 in which group G2 is extended to apply the preliminary tension fX to respective of the strands in that group, and the group is then extended by a displacement of d22 wherein d22=(E2−EX2)+(EX3−E3);
- Stage 23 in which G3 is extended to apply only the preliminary tension fX to respective of the strands in that group; and
- Stage FFF in which all groups are simultaneously extended by a distance dFF by the jack to their final displacement length wherein dFFF=E3−EX3

Compared to the method of FIG. 5, in the embodiment of FIG. 6 the tendon group with the shortest free length (e.g., G3) is also tensioned to the preliminary tension level thereby adding an addition step in the tensioning process. Moreover, whilst in the embodiment of FIG. 6 the common preliminary tension is applied to a strand group and that strand group is then extended to its respective initial displacement length prior to this being repeated for the next strand group in the tensioning sequence, in other embodiments all of the strand groups may first be tensioned in sequence to the preliminary tension level and subsequently then be tensioned to their respective initial displacement lengths, generally in the same sequence.

In tendons grouted over their full length the tensioning method illustrated in FIG. 2 or FIG. 5 are the most appropriate to use as any free length slack prior to tensioning of the tendon will generally not be significant to the final result.

From the description of the above embodiments of the invention, it can be seen that individual groups of the strands are initially extended by a different length compared to one another so as to be tensioned to a respective initial displacement length from a resting condition in the bore and to a greater tension level than a final group of the strands, prior to subsequent tensioning of all of the groups of the strands at the same time by the same predetermined length to a respective final displacement length.

The displacement length that the different groups of strands 12 are respectively extended in the tensioning stages of methods embodied by the invention to tension the tendon 10 can be readily calculated by a civil engineer or qualified technician prior to effecting the tensioning, and is a function of the relative strand free length and relative bond length location of the respective strand group (i.e., G1-G3 etc.) as well as the overall length of, and load required in, the tendon. Typically, the strands of a tendon 10 will be divided into 2 to 5 strand groups and the groups then tensioned in sequence to their respective initial displacement length as described above, before all of the strand group are collectively tensioned at the same time with a single jacking device to their respective final displacement length and thereby tension.

Typically, all of the strands within a strand group will be tensioned at the same time during the tensioning of the group. However, in at least some embodiments, the strands within a strand group can be respectively individually tensioned utilising a suitable strand jacking arrangement during a preliminary and/or intermediate tensioning stage although, all of the strand groups in such embodiments are nevertheless still tensioned simultaneously to their respective final displacement length in the final tensioning stage.

The bond lengths of the strands of the tendon 10 are staggered along the bond zone of the tendon and define respective load transfer regions for transfer of load from the tendon to the rock foundation, via the grout about the bond lengths of the strands within the corrugated sheath 24 and the grout in the bore about that sheath. The corrugations of the sheath 24 facilitate the mechanical load transfer through the sheath via the internal and external grouts.

Upon the strands 12 of the tendon 10 being stressed/tensioned to the final required tension, the hydraulic jack and the auxiliary anchorage are removed, and the protruding strands 12 projecting from the primary anchoring head 44 are cut evenly to a manageable length. The clamping wedges 36 remain permanently in position in the primary anchoring head 44 to maintain the tension in respective strands of the tendon and secure the tendon via the bearing plate 42 to the dam spillway (i.e., the load). The protruding strand ends 12 can be treated (e.g., greased) to inhibit corrosion before encasement and/or a cover is fitted over the strands and fastened in position with the use of mechanical fasteners such as screws or bolts.

A tendon used in an embodiment of the invention can have any number of strands, limited only by geotechnical, grout and project's physical restrictions. Typically, when tensioned to their final tension, the tension in the respective strands of the tendon can be within 2-3% of MBL (Minimum Breaking Load) relative to each other. This difference in tension is an effect of necessary stagger in the position of the free length/bond length junction of the strands, where it is not possible to abruptly have all strands within a group coincide at exactly the same location, due to spacial constraints and possible differing properties of different batches of strand that may be utilised within the one tendon.

From the above, it will be clear that embodiments of the invention provide for the use of anchoring tendons in situations with relatively low geotechnical strength materials through to tendons as exemplified above (e.g., 91 strand) to provide for ultra-high load transfer capacity tendons with greater than 91 strands, e.g., >25,400 kN UTS. More particularly, the load transfer capacity of a tendon tensioned in accordance with an embodiment of the invention will typically be at least about 1500 kN UTS, and more preferably, at least about 3000 kN UTS, 5000 kN UTS, 7000 kN UTS, 8000 kN UTS, 13750 kN UTS or 16250 kN UTS or greater. Moreover, while the invention has been described herein in relation to the use of ground tendons with multiple, multi-wire strands 12, it will be understood the invention extends to tendons with multiple rod or bar strands or the like.

Although the invention has been described in relation to a number of embodiments, it will be appreciated that numerous variations and modifications can be made without departing from the invention. The present embodiments are, therefore, merely illustrative and not restrictive.

The invention claimed is:

1. A method for anchoring a load to an anchorage, comprising:

providing at least one unitary anchoring tendon including a plurality of tensile elements each having a bond length and a free length, the tensile elements being fixed together at a leading end of the tendon;

forming a respective bore through the load into the anchorage for each said tendon;

inserting a said tendon lengthwise into the respective said bore for the tendon such that the leading end of the tendon is passed through the load into the anchorage, wherein the tensile elements are ordered into different groups, the free length of the tensile elements in each said group being different to the free length of the tensile elements in each other said group whereby the bond length of the tensile elements of the different said groups provide bond transfer regions of the tendon that are staggered from one said group to the next along a bond zone of the tendon for load transfer to the anchorage via grout with tensioning of the groups of tensile elements;

once the grout has sufficiently cured or set, tensioning the different said groups of tensile elements in a predetermined sequence to extend the free length of the tensile elements to a respective initial displacement length, to compensate for the differences in the free length of the tensile elements between respective of the groups;

subsequently, collectively further tensioning all of the tensile elements of the tendon together to extend the free length of all of the tensile elements by a predetermined length to a respective increased final displacement length; and securing the tendon to the load to maintain the tension in the tensile elements.

2. A method according to claim 1, wherein the tensile elements of the tendon are tensioned in sequence from tensile elements with the longest free length to tensile elements with the shortest free length.

3. A method according to claim 1, wherein the tensioning of respective of the groups to their initial displacement length comprises collectively tensioning groups lower in the order with each group that is higher in the order, in turn.

4. A method according to claim 3, wherein each said group lower in the order is extended in said sequence by a length determined to compensate for difference in the free length of the tensile elements in the lower order said group with the tensile elements in the group that is next highest in the order.

5. A method according to claim 2, wherein each said group lower in the order is extended in said sequence by a compensating length determined to compensate for difference in the free length of the tensile elements in the lower order said group with the tensile elements in the group that is highest in the order.

6. A method according to claim 5, comprising tensioning the tensile elements in each said group to a common predetermined tension level and further extending each said group lower in the order by the respective said compensating length.

7. A method according to claim 1, wherein tensioning means consisting of a single jacking device is used for at least the tensioning of the groups of tensile elements to their respective final displacement.

8. A method according to claim 1, wherein a primary sheath is provided in the bore and at least the bond lengths of the tensile elements are disposed in the sheath, and the grout comprises internal grout about the respective bond lengths of the tensile elements and external grout in the bore outside of the sheath.

9. A method according to claim 8, wherein the sheath is corrugated to facilitate load transfer to the anchorage.

10. A method according to claim 8, wherein the free lengths of tensile elements of the tendon are disposed in a straight walled sheath mounted on top of the primary sheath.

11. A method according to claim 1, wherein the load anchored by the anchoring tendon is selected from the group consisting of ground, earthen, building, and engineering structures or formations.

12. A method according to claim 11, wherein the load is a dam wall.

13. A unitary anchoring tendon for being positioned lengthwise in a respective bore formed through a load into an anchorage to anchor the load to the anchorage, the tendon having a leading end for being located down the bore into the anchorage and the tendon comprising a plurality of tensile elements ordered into different groups for tensioning of the groups in a predetermined sequence, each of the tensile elements having a bond length and a free length, and the bond lengths of the tensile elements being fixed together at the leading end of the tendon, the free length of the tensile elements in each said group being different to the free length of the tensile elements in each other said group whereby the bond length of the tensile elements of the different said groups provides bond transfer regions of the tendon that are staggered from one said group to the next along a bond zone of the tendon for load transfer to the anchorage via grout in the bore with the tensioning of the different groups of the tensile elements in the predetermined sequence.

14. An anchoring tendon according to claim 13, wherein the free length of each said tensile element is received in a respective sleeve.

15. An anchoring tendon according to claim 13, wherein the tensile elements are fixed together at the leading end of the tendon by an epoxy.

16. An anchoring tendon according to claim 13, wherein the tendon has at least 19 tensile elements.

17. An anchoring tendon according to claim 13, wherein the load transfer capacity of the tendon is at least 1500kN UTS.

18. An anchoring tendon according to claim 13, wherein the different groups of tensile elements are differentially identified thereby defining the predetermined sequence for the tensioning of the groups to extend the free length of the tensile elements in each said group to a respective initial displacement length once the grout has sufficiently cured or set.

19. An anchorage system according to claim 18, wherein different groups of the tensile elements of the tendon are differentially identified by one or more of the following selected from the group consisting of markings, cuttings, colours, sheathing, tagging, heatshrink wrap, and labeling.

20. An anchorage system according to claim 13, wherein the tensile elements of the tendon are selected from the group consisting of strand, rod, wire, cable, and bar elements.

* * * * *